US006907640B2

(12) United States Patent
Rougeau

(10) Patent No.: US 6,907,640 B2
(45) Date of Patent: Jun. 21, 2005

(54) VERTICAL PAINT TRAY

(76) Inventor: Ronald Rougeau, 2-552 Richot Street, Winnipeg, Manitoba (CA), R2H 2X3

( * ) Notice: Subject to any disclaimer, the term of this patent is extended or adjusted under 35 U.S.C. 154(b) by 29 days.

(21) Appl. No.: 10/440,223

(22) Filed: May 19, 2003

(65) Prior Publication Data

US 2003/0204929 A1 Nov. 6, 2003

Related U.S. Application Data

(63) Continuation-in-part of application No. 09/785,295, filed on Feb. 20, 2001, now abandoned.

(51) Int. Cl.[7] ..... B44D 3/14

(52) U.S. Cl. ..... 15/257.06; 15/257.05; 220/570; 248/210

(58) Field of Search ..... 15/144.1, 144.2, 15/257.06, 257.05; 220/570; 248/211, 210

(56) References Cited

U.S. PATENT DOCUMENTS 3,351,970 A 11/1967 Engh
3,641,616 A * 2/1972 Bonci ..... 15/257.06
3,707,242 A * 12/1972 Golden et al. ..... 220/570
3,822,846 A * 7/1974 Jesionowski ..... 248/210
3,837,034 A 9/1974 Leffert et al.
3,940,824 A 3/1976 Gioia et al.
D293,144 S * 12/1987 Papke et al. ..... D32/53.1
4,787,586 A 11/1988 Crain
D303,304 S * 9/1989 Sabatino ..... D32/53.1
5,493,751 A 2/1996 Misiukowiec et al.
5,511,279 A 4/1996 Ippolito
5,836,043 A 11/1998 Rovas
6,612,459 B2 * 9/2003 Young ..... 220/570

* cited by examiner

*Primary Examiner*—Robert J. Warden, Sr.
*Assistant Examiner*—S Balsis
(74) *Attorney, Agent, or Firm*—Adrian D. Battison; Michael R. Williams; Ryan W. Dupuis

(57) ABSTRACT

An apparatus for dispensing paint comprises a container arranged to contain paint, the container has an open top end of the container providing access to the paint by a user, an enclosed bottom end on the container and a front inner side of the container. The front inner side has a plurality of raised protrusions for rolling off excess paint of a paint roller. A mounting arrangement is located at the top end on a back side of the container for supporting the container in a raised position on a vertical structure. A supporting arrangement is located at the bottom end for supporting the container such that the container remains in a generally vertical position. The mounting arrangement is arranged such that the raised protrusions on the front inner side of the container face towards the user on the vertical structure.

4 Claims, 12 Drawing Sheets

11
7
9
3
3
45

VERTICAL PAINT TRAY

FIELD OF THE INVENTION

The present application is a Continuation-in-Part Application of an application filed Feb. 20, 2001, Ser. No. 09/785,295, now abandoned.

The present invention relates to a paint tray, more particularly a paint tray for use on a ladder or the like.

BACKGROUND

Conventional paint trays used for roller type painting devices are flat pans which have a bottom reservoir wherein paint is contained and a ribbed angled portion wherein the roller is rolled to remove excess paint. These type of paint trays maybe useful when positioned in a stationary place such as a ground surface but may not be suitable for use on ladders. Since the trays have a reasonably large opening they may be susceptible to spillage when on a ladder which can cause a considerable mess to clean.

A number of Patents have been issued for paint trays which can be mounted on to a ladder or scaffold or can also be carried by an individual. Some examples of these paint trays are found in U.S. Pat. Nos. 5,493,751 (Misiukowiec et al), U.S. Pat. Nos. 5,836,043 (Rovas), U.S. Pat. Nos. 3,940,824 (Gioia et al), and U.S. Pat. Nos. 3,351,970 (Engh). These examples of paint trays have a generally vertical containing arrangement which allows a user to place the tray on a ladder or scaffold. These examples however, have a relatively large opening which may not contain the paint sufficiently thereby the paint within the container while in use may be spilled or splashed onto surrounding surfaces or areas.

Some other examples of paint trays are disclosed in U.S. Pat. Nos. 5,511,279 (Ippolito), U.S. Pat. Nos. 4,787,586 (Crain) and U.S. Pat. Nos. 3,837,034 (Leffert et al).

SUMMARY

The vertical paint tray is a sturdy splash proof polypropylene container designed to streamline ladder and scaffold work. It works in all other conventional painting positions and increases labor efficiency.

The vertical tray mounts any way a user will need it, at any angle, at any height, on ladders, scaffolds and temporary safety structures. Tools are balanced nearby in all applications. The entire design leaves the work platform free and clear of obstructions and provides an ergonomic benefit to painters and other trades persons.

The paint tray has a lid which reduces spillage and handles providing a user with suitable means for picking up and moving around a job site.

A reusable paint liner divides the container into two sections allowing a user to carry two types of paint for preferred applications.

In a preferred embodiment of the present invention there is provided an apparatus for dispensing paint comprising:

a container arranged to contain paint having a front wall, a rear wall and two side walls and a closed base;

the side walls being parallel;

an open top end of the container defined by upper edges of the front, rear and side walls providing access to the paint by a user;

the front and rear walls converging from the open top end toward the base such that the base is narrower than the open top and such that the side walls are generally triangular;

a mounting arrangement located at the top end for supporting the container in a raised position on a vertical structure;

a supporting arrangement arranged to be located at the base for attaching the container to a rung of a ladder;

the front, rear and side walls having the upper edges thereof lying in a common plane defining the open top end.

Preferably an insert plate is arranged to be located to an inner side of the front wall has a plurality of raised protrusions.

Preferably a lip extends outwardly from each side wall at the open top end is arranged to receive a lid.

Preferably a separator wall is arranged to be located within the container parallel to the side walls.

Preferably the supporting arrangement has a pair of movable arms extending from each respective side wall.

Preferably a clip member is located at the end of the moveable arms.

Conveniently the moveable arms rotate about an axis.

Conveniently the arms have a slot providing inward and outward movement relative to the container.

In another embodiment of the present invention there is provided an apparatus for dispensing paint comprising:

a container arranged to contain paint having a front wall, a rear wall and two side walls and a closed base;

the side walls being parallel;

an open top end of the container defined by upper edges of the front, rear and side walls providing access to the paint by a user;

a mounting arrangement located at the top end for supporting the container in a raised position on a vertical structure;

a moveable supporting arrangement having;

a pair of movable arms extending from each respective side wall;

a clip member being located at the end of the moveable arms;

the moveable arms rotate about an axis;

the arms have a slot providing inward and outward movement relative to the container.

BRIEF DESCRIPTION OF THE DRAWINGS

In the accompanying drawings, which illustrate an exemplary embodiment of the present invention.

DETAILED DESCRIPTION

Figure 1:
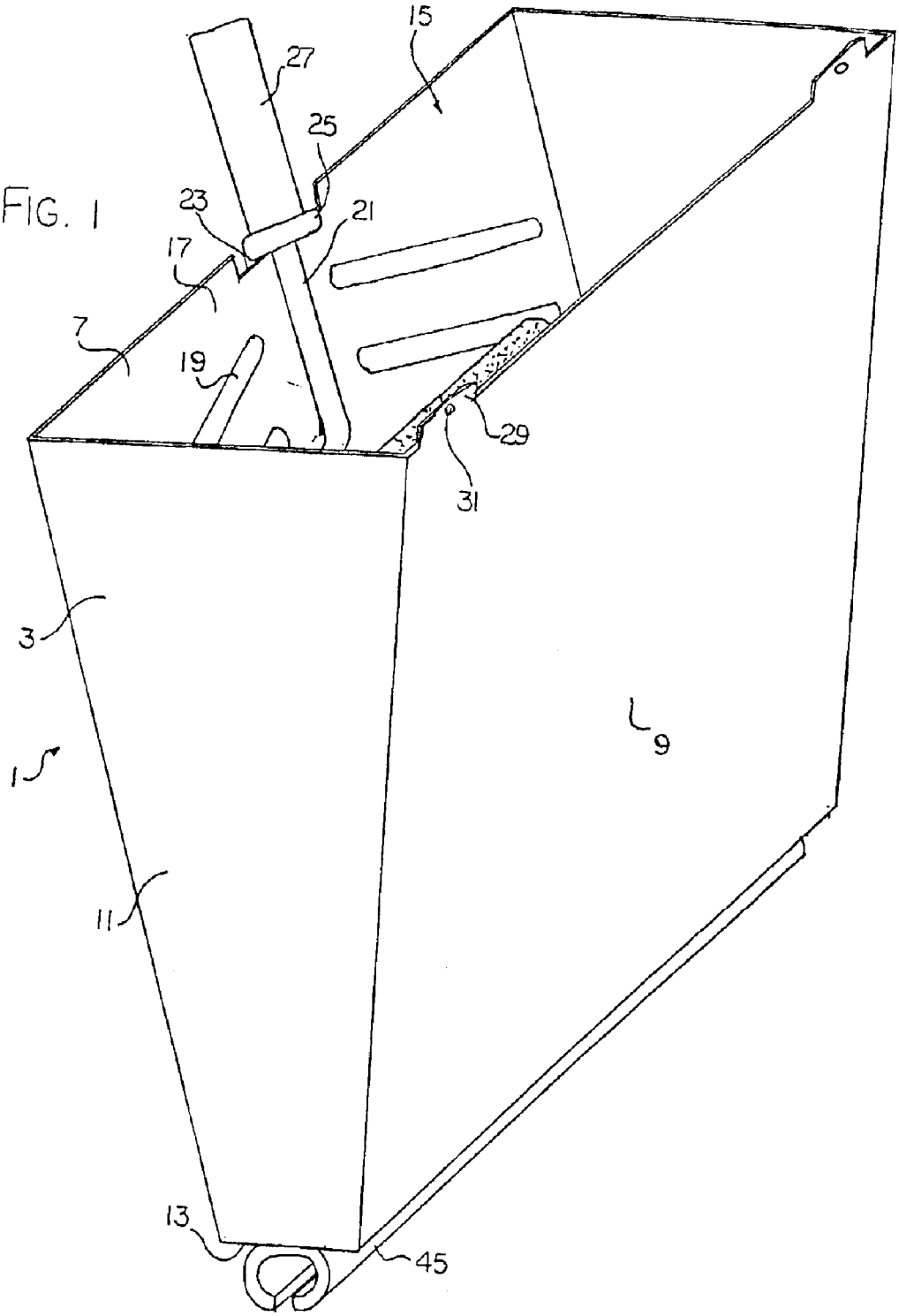
FIG. 1 is an isometric view of the present invention.
Figure 2:
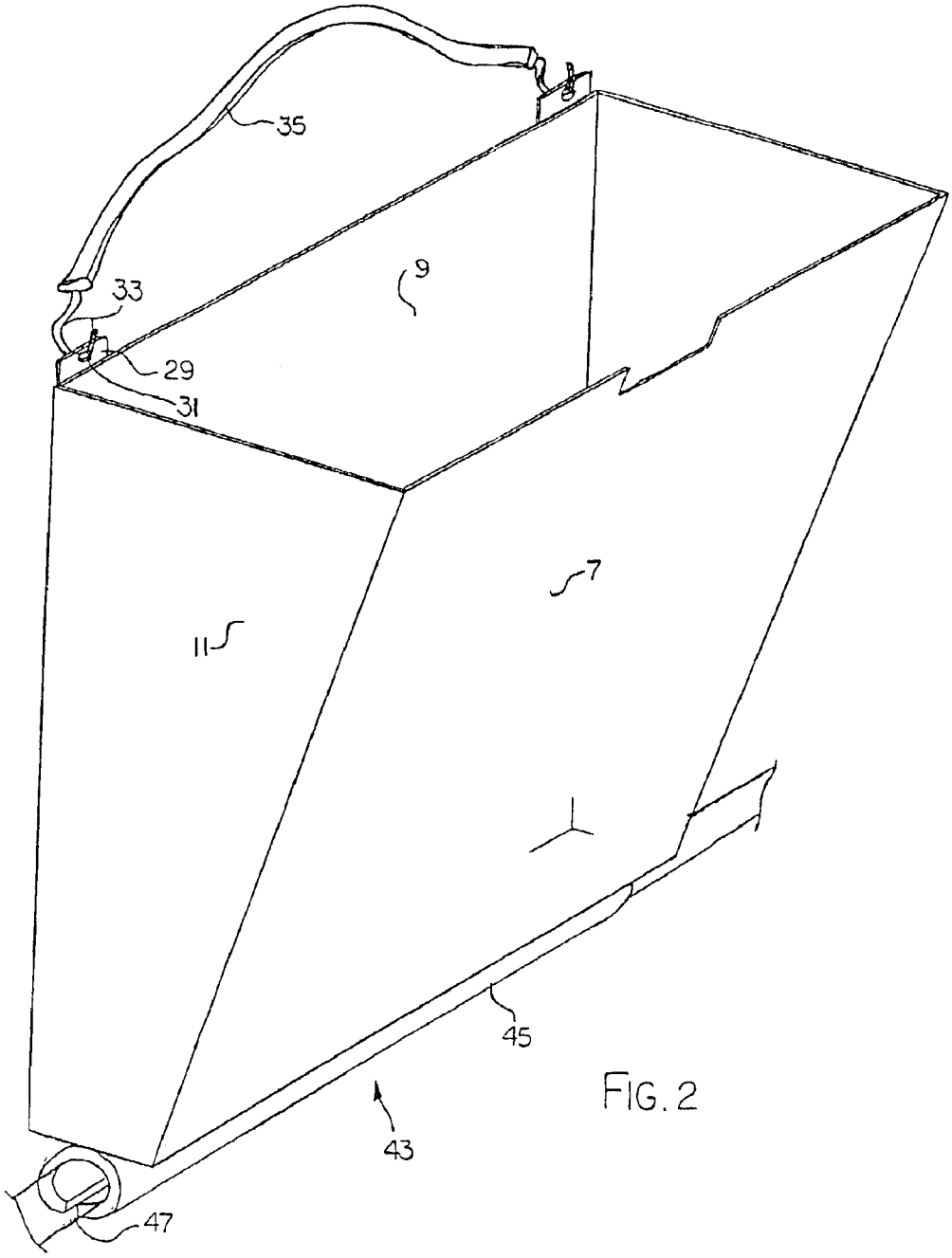
FIG. 2 is an isometric view of the present invention.
Figure 3:
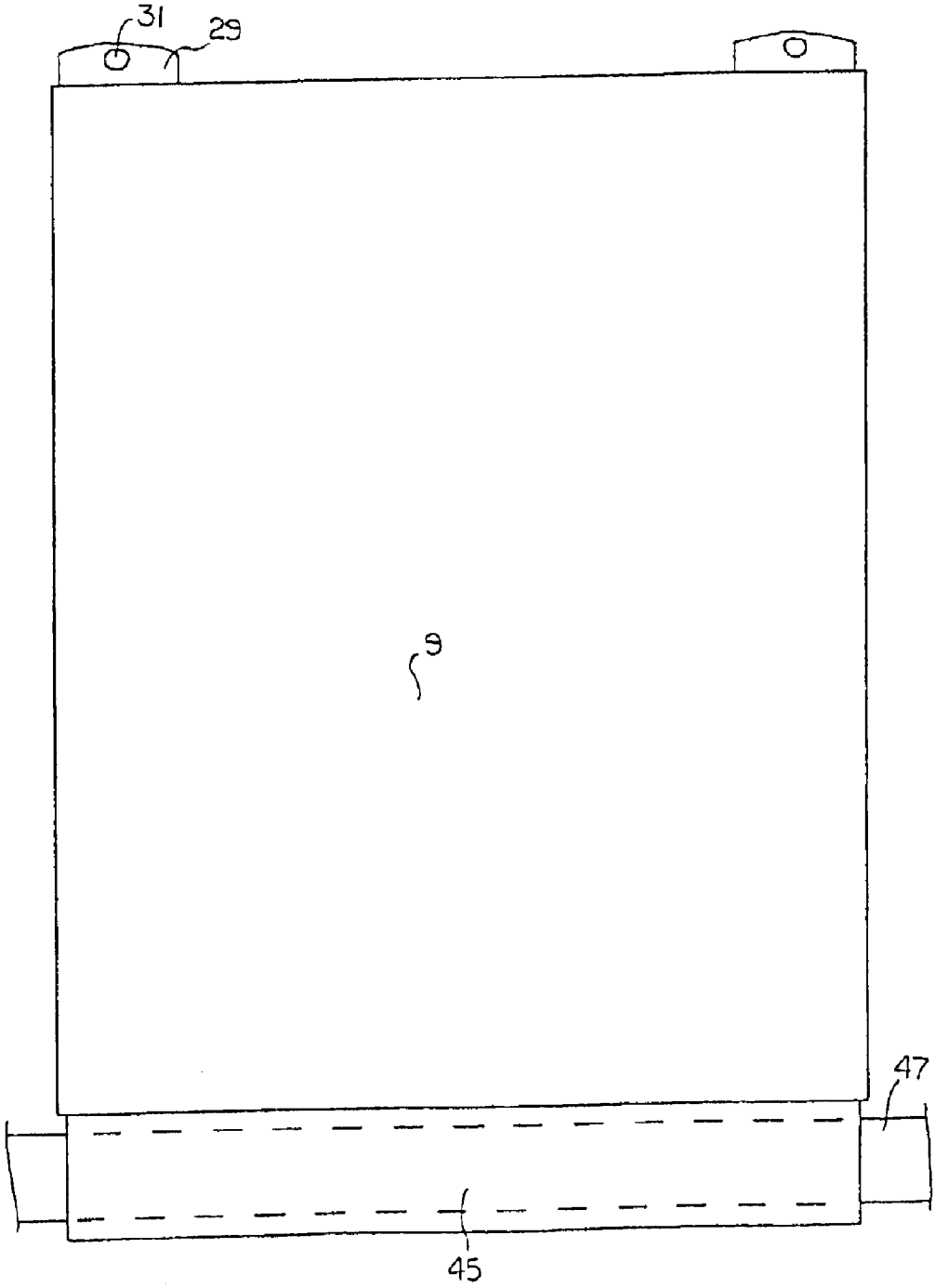
FIG. 3 is a front elevational view of the present invention.

Referring to the accompanying drawings, there is illustrated an apparatus for dispensing paint 1. The apparatus utilises a container 3 which is arranged to contain paint 5. The container has a front wall 7, a back wall 9 and two side walls 11 connecting the front and back walls. The side walls are substantially triangular in shape such that the front wall extends downwards at an angle and the container has a bottom side 13 which encloses the container. The container has an open top end 15 which provides access to the paint within the container. The width at a top end between the front wall and the back wall is larger than the width at the bottom end between the front wall and the back wall. The height of each wall is substantially the same at the top end providing an enclosure so that paint does not spill or splash onto surrounding areas from within the container.

An inner surface 17 of the front wall has two rows of raised protrusions 19 which are used in association with a paint roller 21. The protrusions allow a user to roll the paint roller thereon so that excess paint is removed from the roller, as well known in the art. The raised protrusions are located within the container on the front wall so that the paint does not splash out of the container. The front wall has an indent 23 which is arranged to receive a lip 25 on the handle 27 of the roller. The indent allows a user to place the roller in the container without having to submerge the roller within the paint contained in the container.

Figure 4:
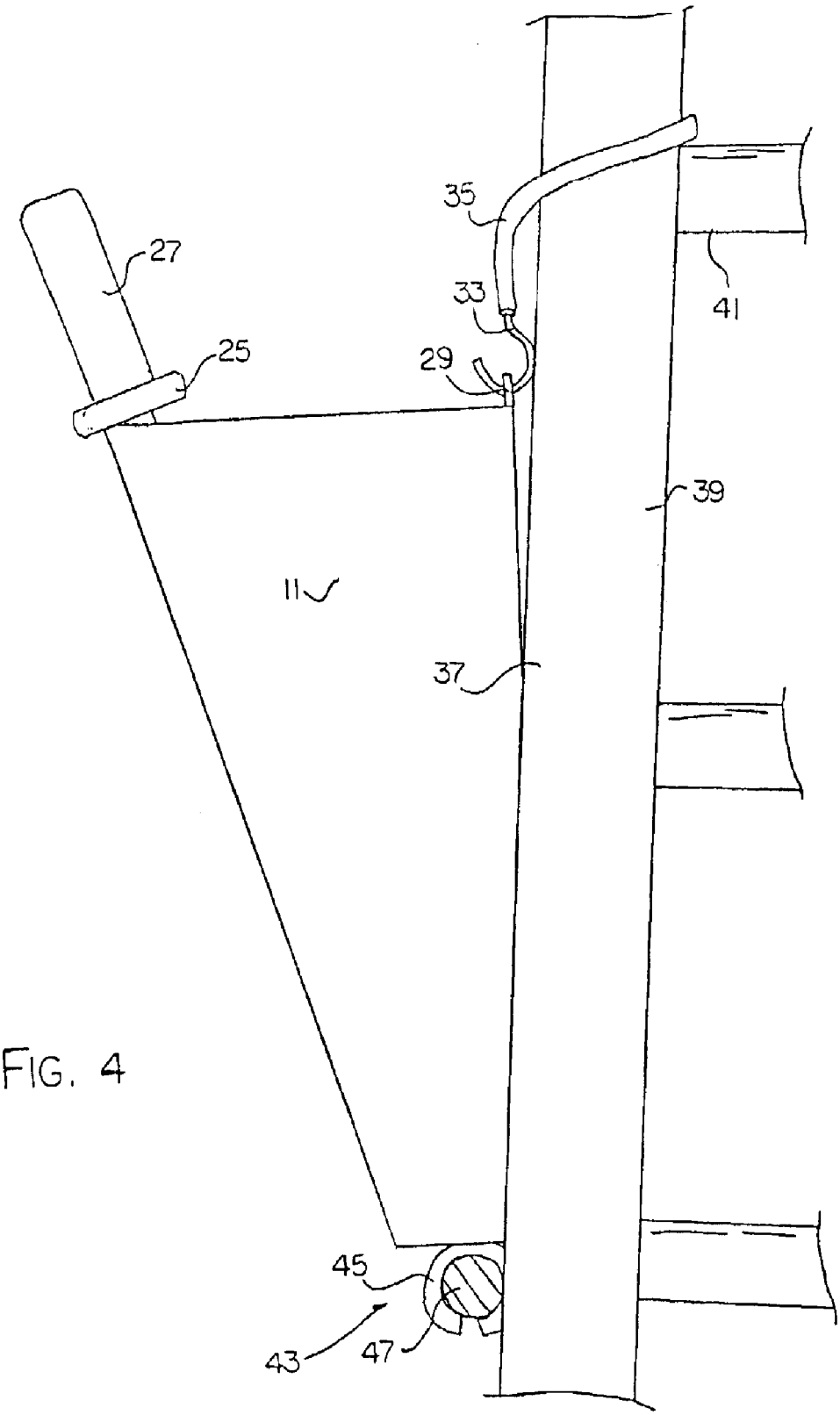
FIG. 4 is a side elevational view of the present invention.
Figure 5:
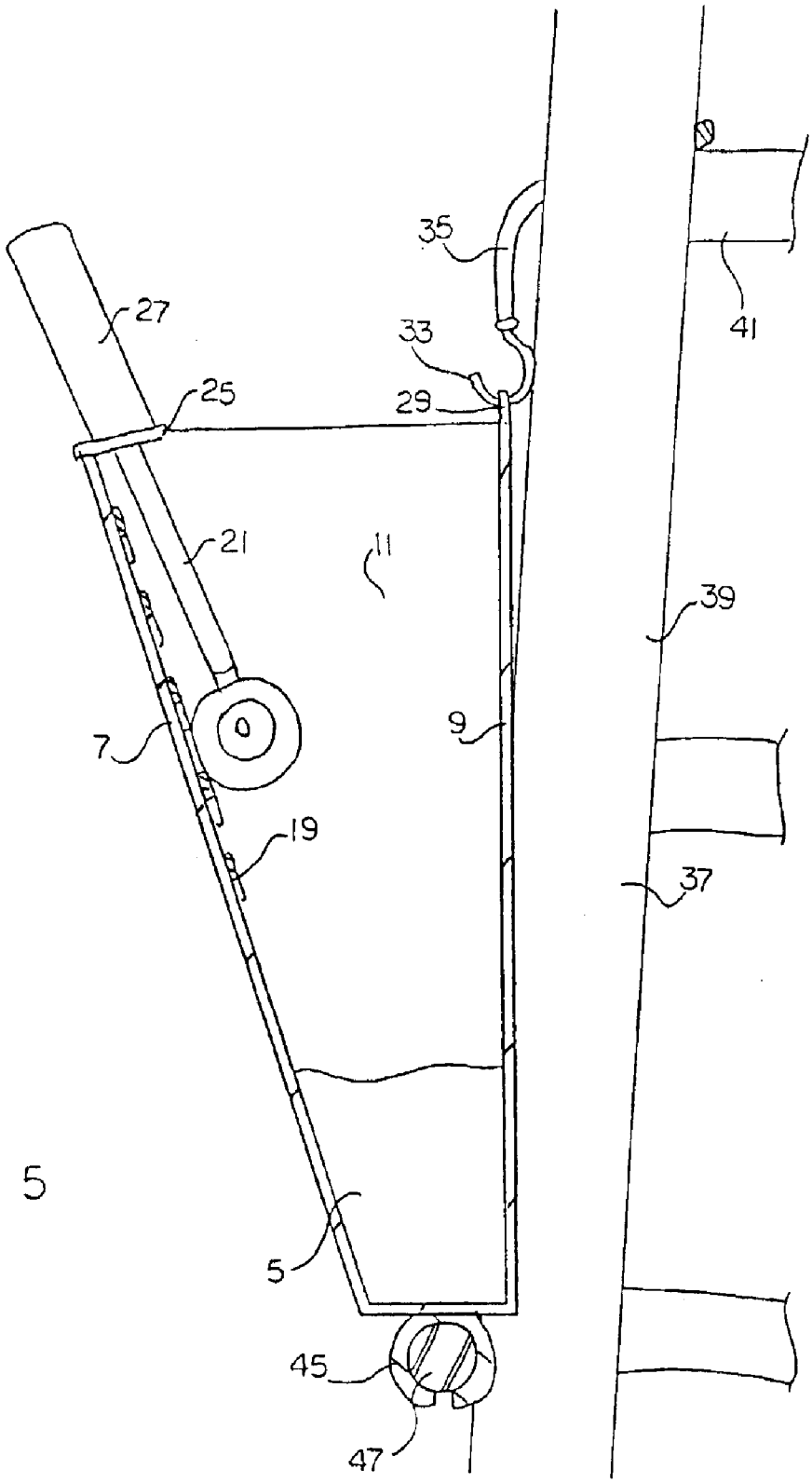
FIG. 5 is a vertical cross section along the lines 5—5 of FIG. 1.

A pair of tabs 29 are located at the top end of the back wall adjacent a respective side wall. Each tab has a hook hole 31 each being arranged to receive a hook 33. Each hook is connected to an end of a bungee cord 35 which allows the container to be mounted to a ladder or scaffold 37. The bungee cord, as best shown in FIGS. 4 and 5 is wrapped around posts 39 of the ladder above a step 41 thereon such that the container can be hung from a ladder. Thus providing a user with access to the container while being positioned on a ladder.

The container is supported in a generally vertical manner on the ladder by a supporting arrangement 43. The supporting arrangement has a clasp 45 mounted on the bottom end of the container and is arranged to clasp a rod 47 which extends outwards past each side wall for engaging the post of the ladder prohibiting the container from swaying forwards and backwards. The clasp is arranged such that the rod can be an extension pole for the roller thereby allowing the user to have access to the desired tools while remaining on the ladder.

Figure 6:
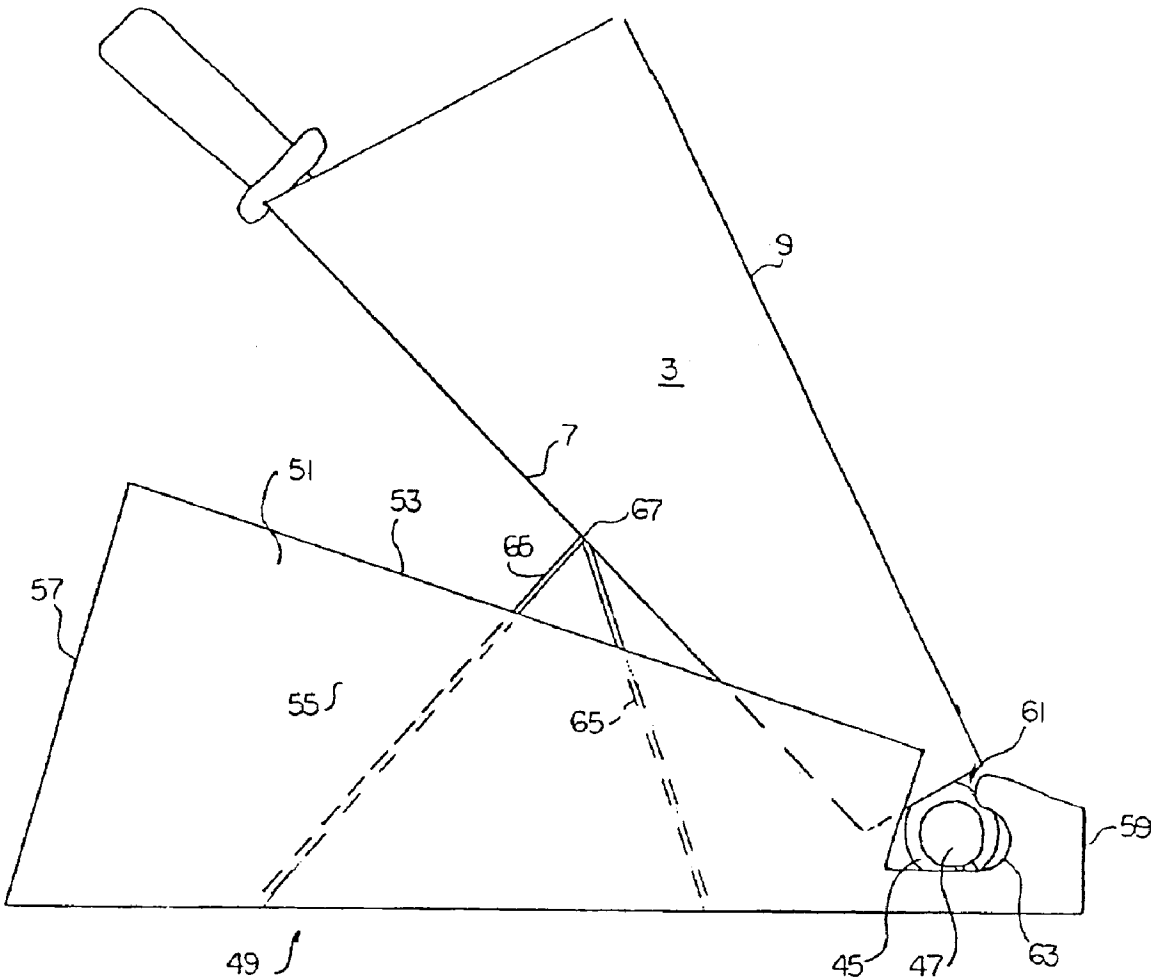
FIG. 6 is a side elevational view of the present invention.
Figure 7:
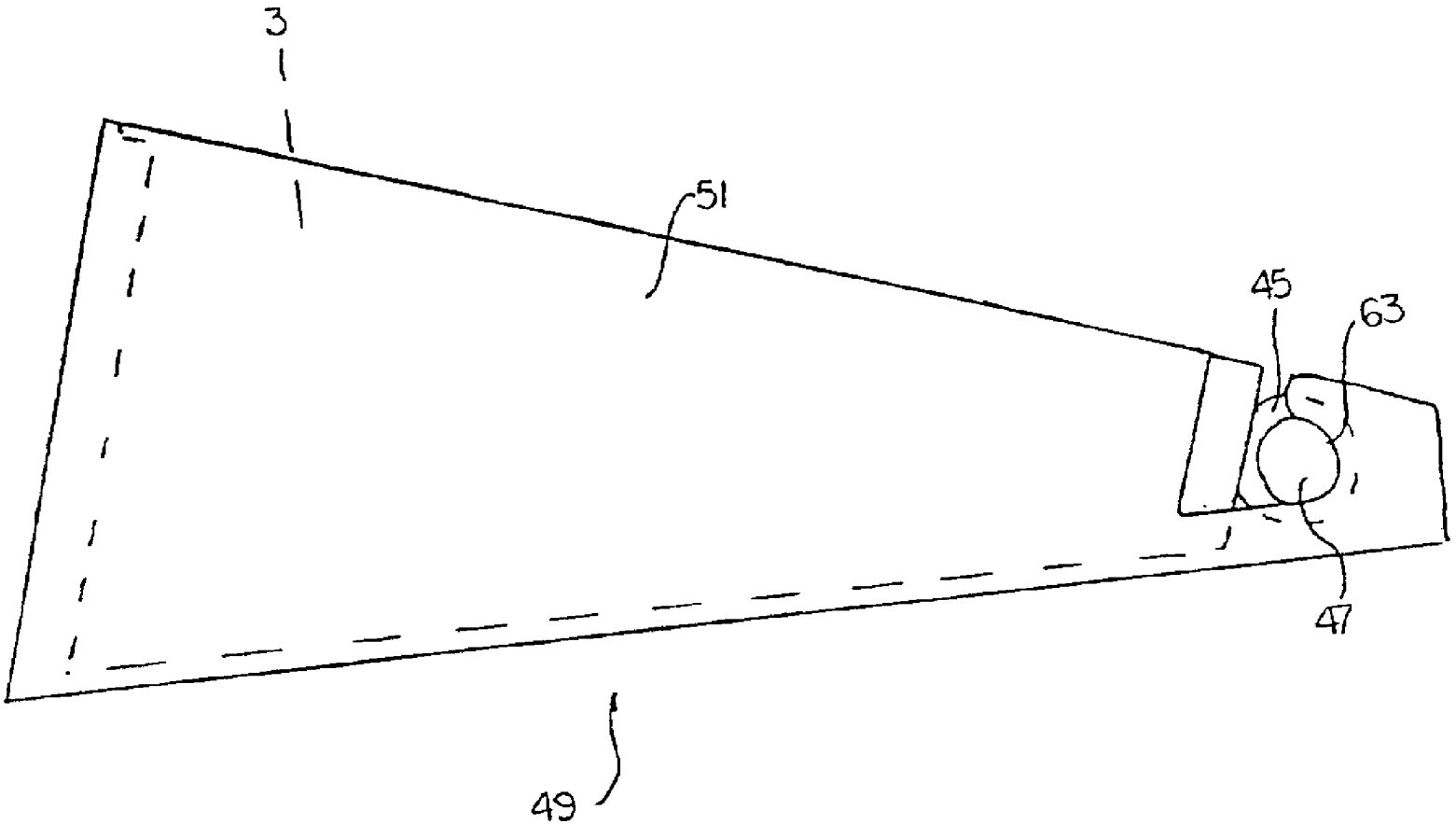
FIG. 7 is a side elevational view of the present invention.

A cradle 49, as best shown in FIGS. 6 and 7, is arranged to support the container on a horizontal surface. The cradle has a main body 51 wherein the container is arranged to fit therein. The cradle has an open top portion 53, side walls 55, a front wall 57 and a back wall 59. Adjacent the back wall on each side wall is an insert portion 61. The insert portion is arranged to receive the rod supported by the clasp such that the container is pivotally connected thereto. The insert portion extends downwards and has a locking portion 63 which extends rearwards from the insert such that the container can be locked within the cradle.

A pair of support leafs 65 are pivotally mounted to an inner side of the bottom side of the cradle. The leafs are spaced apart such that the leafs can fold one on top of the other within the cradle when the container is positioned therein. The leafs can be pivoted upwards and connected at a top end 67 which provides a support for the front wall of the container. The leafs support the container in a generally upright position for use on a horizontal surface, as best shown in FIG. 6. FIG. 7 shows the container positioned within the cradle for storing and transport of the container prohibiting unnecessary spillage of the paint.

Figure 8:
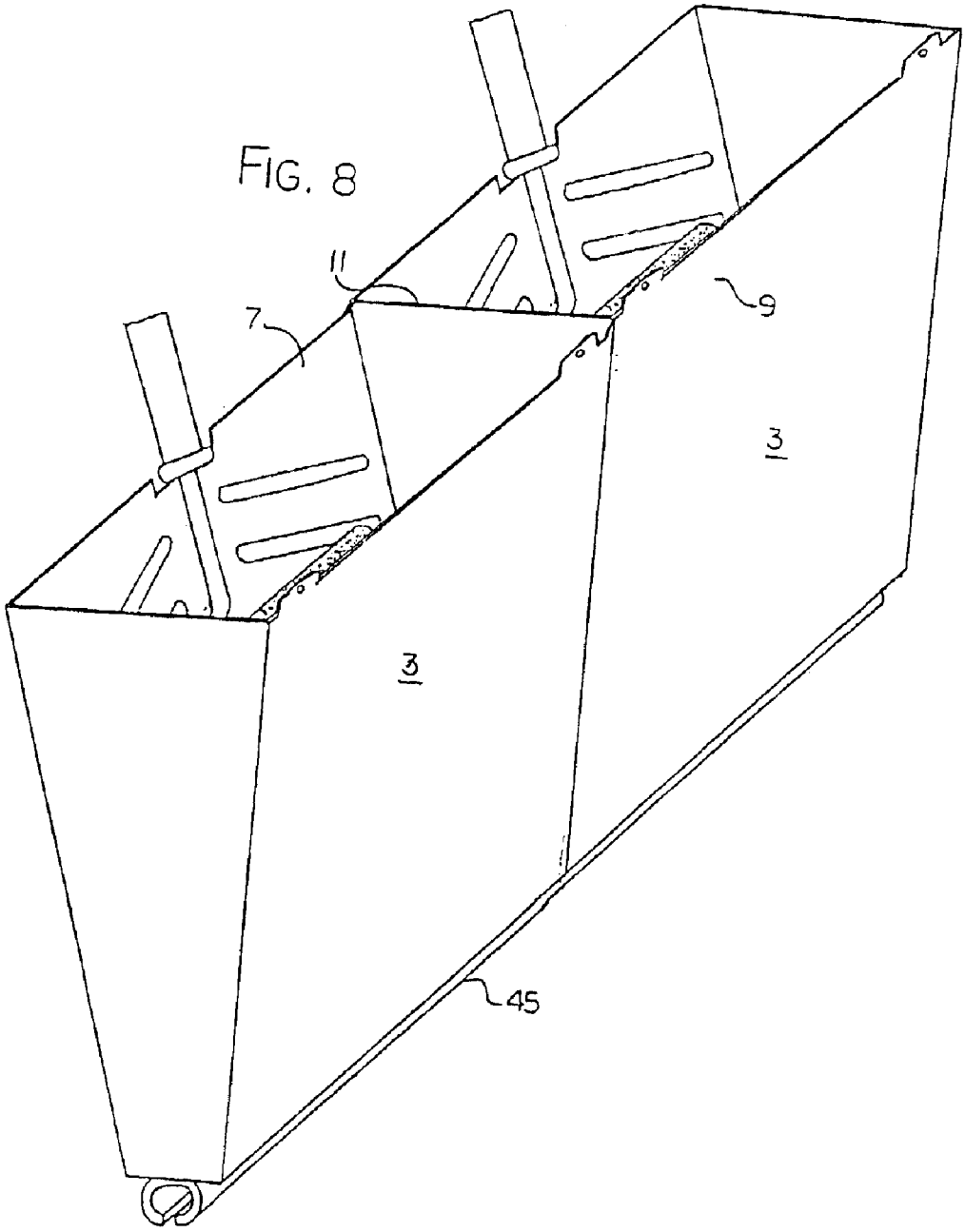
FIG. 8 is an isometric view of a second embodiment of the present invention.

FIG. 8 shows an alternative embodiment of the apparatus wherein two containers are connected at respective side walls such that two different types/colours of paint can be used. The containers are divided by the respective side walls. The clasp extends along the length of the bottom side of the containers and each container has an indent for each paint roller.

Figure 9:
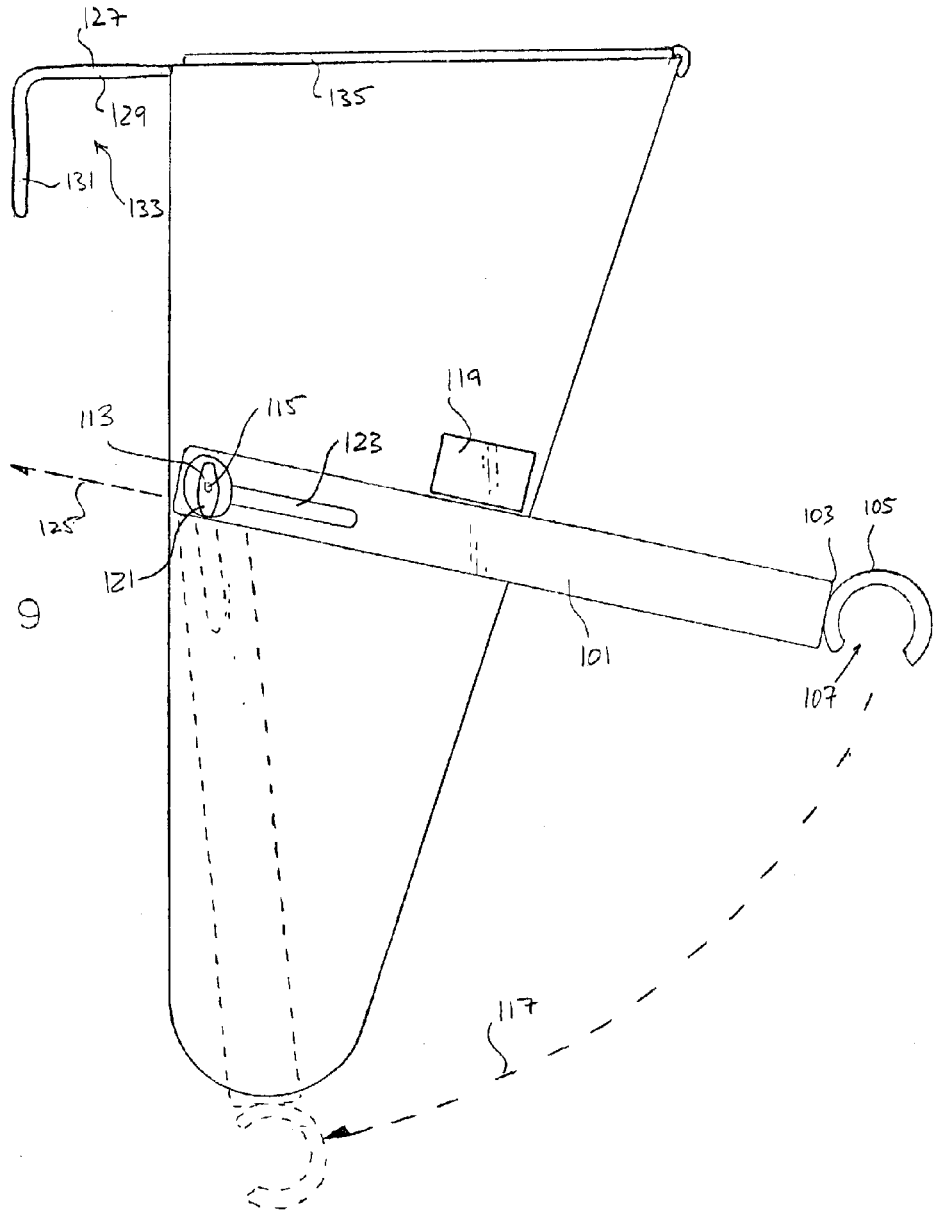
FIG. 9 is an isometric view of a preferred embodiment of the present invention.

The embodiment shown in FIG. 9 illustrates a preferred embodiment of the present invention. The embodiment shown in FIG. 9 has a movable arm 101 extends from each respective side of the main body. At outer ends 103 of the moveable arm are connected by a circular clip 105 which having an open side 107. The open side is arranged to receive a rung or step 109 of a ladder 111 such that the rung is secured within the clip for supporting the tray thereon. The arms can be reversible on the main body such that the open side is either facing upwards or downwards. The arms are moveable on a pivot 113 defining an axis 115 on the main body such that the clip can be located in front of the tray or moved radially about the axis to a specified position, as indicated by arrow 117. A restricter plate 119 on the main body is arranged to prohibit extensive movement of the arm in the upwards direction. The arm is secured to the main body by a butterfly nut 121 which is easily loosened thus allowing the arm to be moved about the axis. The nut is positioned at the arm on respective sides of the main body within a slot 123. The slot allows for movement of the arm in an inwards and outwards direction. The movement provides positioning of the clip for a variety of positions on different sized ladders or scaffold. The inwards and outwards movement is defined by reference arrow 125. A handle 127 at the top end of the main body extends in a rearward direction therefrom. The handle is L-shaped and has a top section 129 extending outwards from the top end and a downward section 131 which extends downwards from the top section parallel to the back side of the main body. The handle is arranged to convenience of carrying the tray and is also arranged to be positioned on a rung or step of a ladder or scaffold in co-operation with the clip such that the rung is positioned within a support area 133 defined between the handle and the back side of the main body. The top end of the main body extending along each side is a lip 135. The lip is arranged to receive a lid 137, illustrated in FIG. 15, described in detail later.

Figure 10:
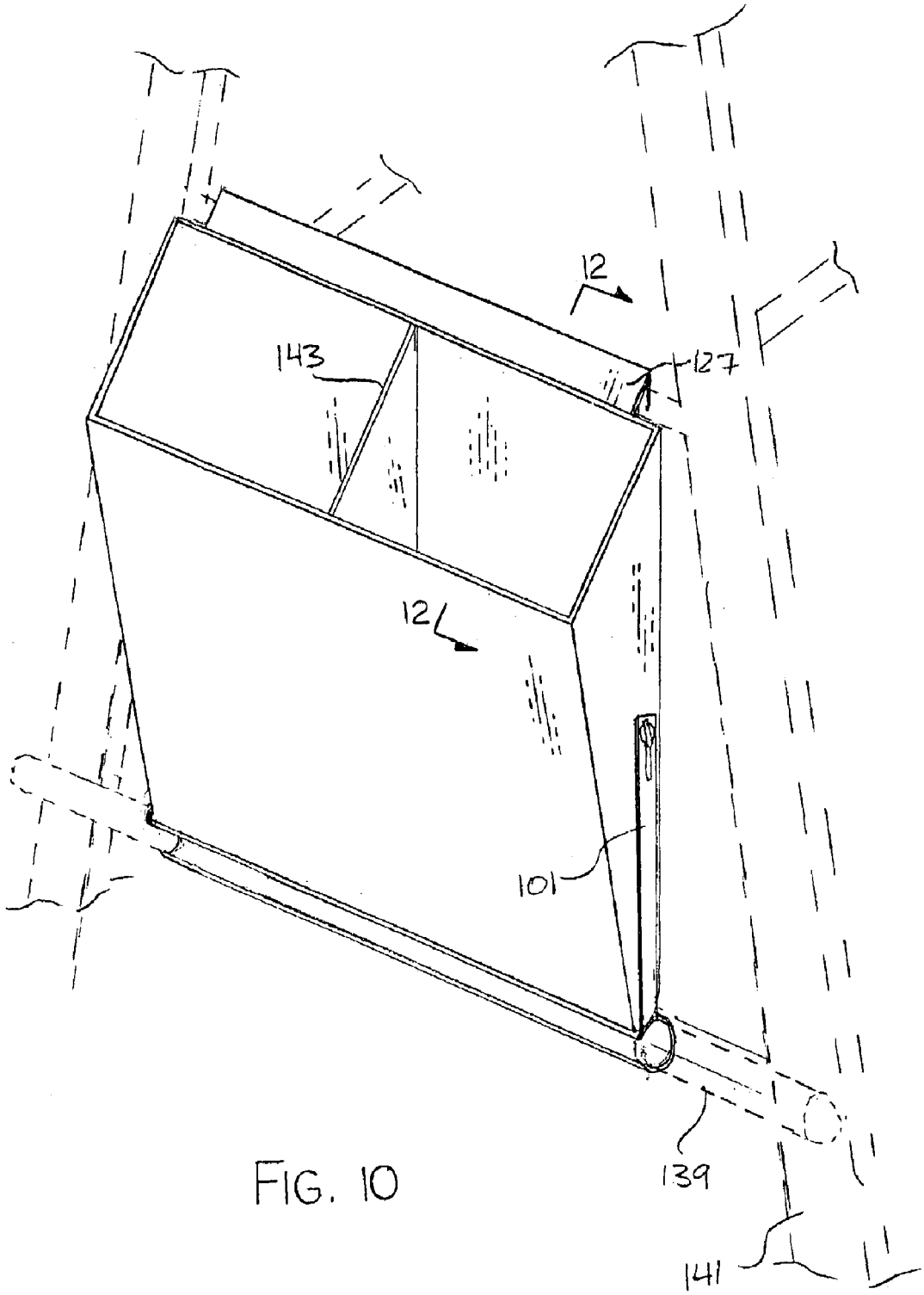
FIG. 10 is an isometric view of the preferred embodiment on a ladder.

FIG. 10 illustrates the preferred embodiment mounted on the side of the step ladder. In this arrangement the arms are extending downwards such that the clip is located at the bottom end of the main body. A support bar 139 is mounted in the clip and extends out each end thereof to engage a leg 141 of the ladder. The bar is arranged to provide stability to the tray as it hangs from the step ladder by the handle. Also, illustrated in FIG. 10, is a separator insert 143 which is inserted into the main body separating two sides therein so that two different types or colours of paint can be used.

Figure 11:
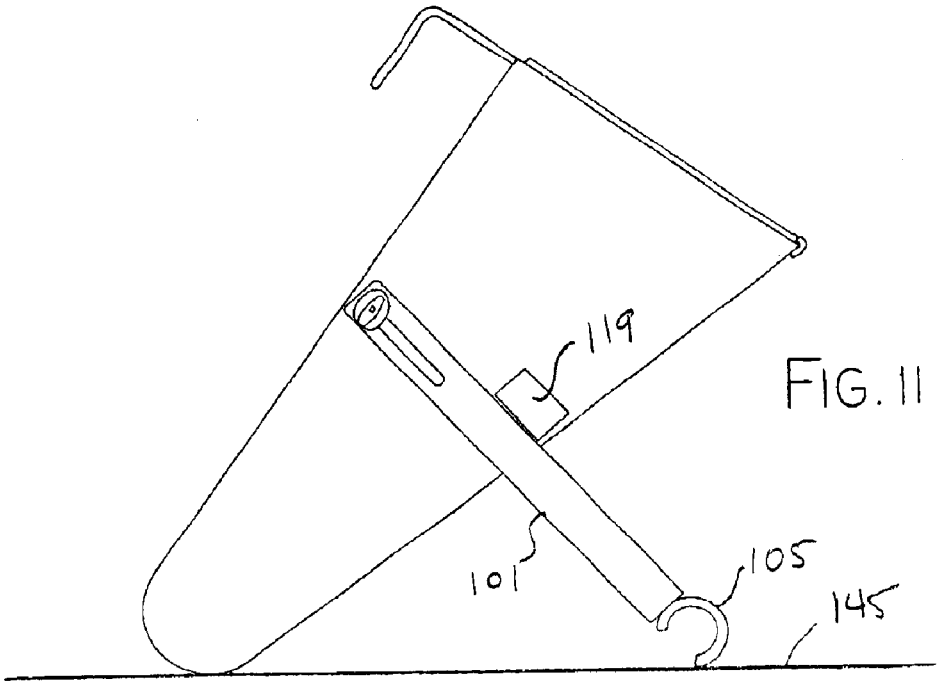
FIG. 11 is a side elevational view of the preferred embodiment on a ground surface.

FIG. 11 illustrates the tray positioned on a work surface or ground 145. The tray is supported on the ground by the clip which is extended in the upwards position abutting the restrictor plate and by the bottom end. The clip and bottom end of the main body engage the ground such that the open top end of the main body is positioned at a suitable angle for convenient access by a user with a roller.

Figure 12:
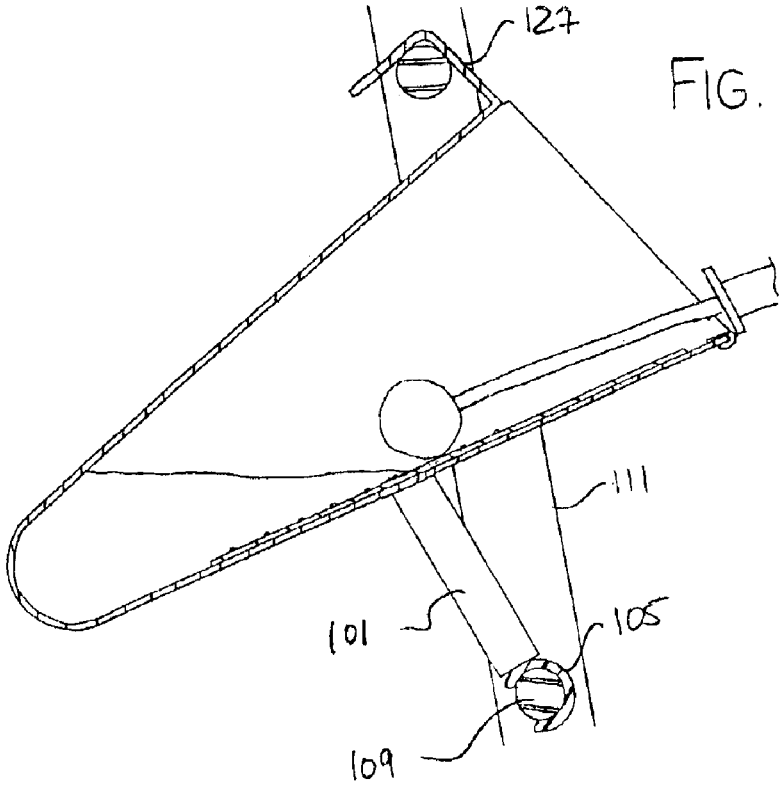
FIG. 12 is a vertical cross section along the lines 12—12 of FIG. 10.

FIG. 12 illustrates the tray supported on a ladder or scaffold. The handle is arranged to engage a step or rung of the ladder or scaffold and the clip is positioned to support the tray in a suitable position.

Figure 13:
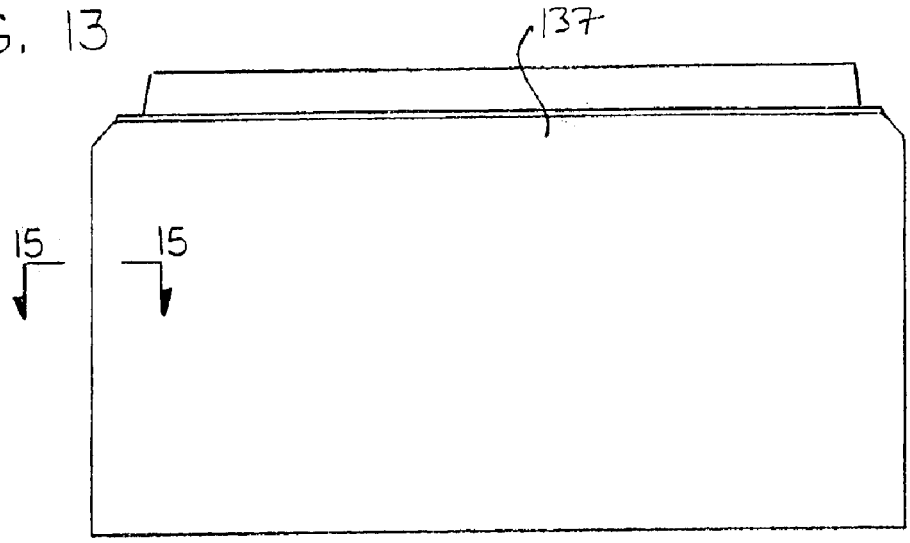
FIG. 13 is a top plan view of the preferred embodiment.
Figure 14:
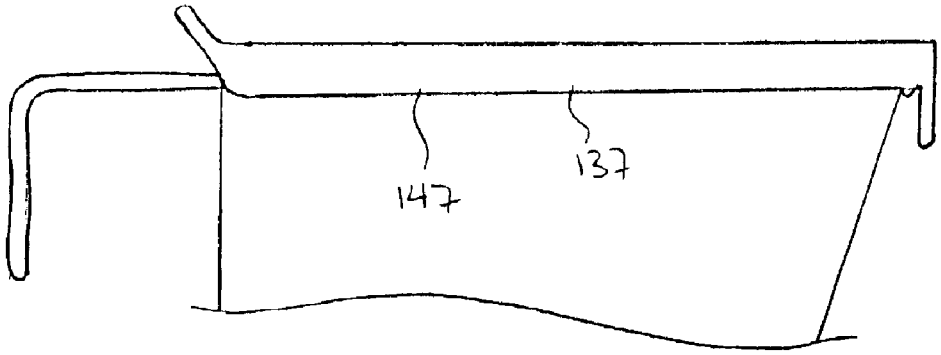
FIG. 14 is a side elevational view of a lid on the preferred embodiment.
Figure 15:
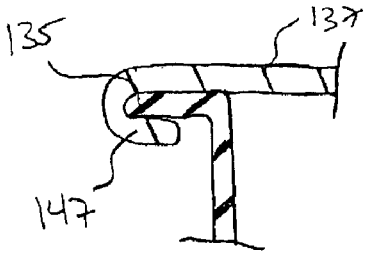
FIG. 15 is a vertical cross section along the lines 15—15 of FIG. 13.

FIGS. 13 through 15 illustrates the lid which is arranged to enclose the open top end for sealing the container. The lid has a hooked side 147, as best illustrated in FIG. 15, which is arranged to correspond with the lip on the top end of the main body. The lid is arranged to slide along the lip from the front end of the main body to enclose the container. The container converts to a compact carrying case for brushes, rollers and other tools and enables easy transportation to and from the job site. The paintbrush clips into the tray. The deep cavity of the tray provides room for scrapers, accessories, paint roller and cage. The clip stores the paint pole. All tools are organised and stored in one package which eliminates the inadvertent need to search for scattered or misplaced tools when the next job comes around.

While one embodiment of the present invention has been described in the foregoing, it is to be understood that other embodiments are possible within the scope of the invention. The invention is to be considered limited solely by the scope of the appended claims.

What is claimed is:

1. An apparatus for dispensing paint comprising:

a container arranged to contain paint having a front wall, a rear wall and two side walls and a closed base;

the side walls being parallel;

an open top end of the container defined by upper edges of the front, rear and side walls providing access to the paint by a user;

the front and rear walls converging from the open top end toward the base such that the base is narrower than the open top and such that the side walls are generally triangular;

the front wall having on an inner surface thereof a series of raised protrusions for engaging a paint roller for removal of excess paint therefrom;

a handle on the top edge of the rear wall;

a mounting arrangement located at the top edge of the rear wall for engaging over a transverse support by which the container can be suspended from the support;

a supporting arrangement comprising a pair of arms each having an inner end mounted on a respective one of the side walls for pivotal movement about a common pivot axis at right angles to the side walls, each arm having an outer end with a transverse clip member extending between the outer ends of the arms parallel to the pivot axis, the clip having an open mouth for engaging on to a rung of a ladder extending alone the clip member;

the arms and the clip member being pivotal about the pivot axis from a first position in which the clip member is located at the base to a second position in which the arms extend from the pivot axis across the respective side wall to the outer ends which support the clip member at a position parallel to and spaced outwardly of the front wall;

the front, rear and side walls having the upper edges thereof lying in a common plane defining the open top end.

2. The apparatus according to claim 1 wherein a lip extends outwardly from each side wall at the open top end and is arranged to receive a lid.

3. The apparatus according to claim 1 wherein there is provided a separator wall which is located within the container parallel to the side walls.

4. The apparatus according to claim 1 wherein each of the arms has a longitudinally extending slot providing inward and outward movement of the clip member relative to the container.

* * * * *